US005087023A

United States Patent [19]

Gilbert et al.

[11] Patent Number: 5,087,023

[45] Date of Patent: Feb. 11, 1992

[54] APPARATUS AND METHOD FOR FOLDING SEPARATED FORMS IN A STACK

[75] Inventors: L. Eldean Gilbert, West Milton; Watson L. Gullett, Spring Valley; W. Edwin Thornburg, Troy, all of Ohio

[73] Assignee: The Standard Register Company, Dayton, Ohio

[21] Appl. No.: 572,041

[22] Filed: Aug. 23, 1990

[51] Int. Cl.[5] ..... B41L 1/32

[52] U.S. Cl. ..... 270/39; 270/31; 493/411; 493/414

[58] Field of Search ..... 270/31, 39, 40; 493/411, 412, 413, 414, 415

[56] References Cited

U.S. PATENT DOCUMENTS

| | | | |
|---|---|---|---|
| 992,473 | 5/1911 | Barber . | |
| 1,024,459 | 4/1912 | Seymour . | |
| 1,858,073 | 5/1932 | Cole . | |
| 2,214,593 | 9/1940 | Mustin . | |
| 2,411,075 | 11/1946 | Wyrick . | |
| 2,675,747 | 4/1954 | Greiner et al. . | |
| 2,936,815 | 5/1960 | Schjeldahl et al. . | |
| 3,048,389 | 8/1962 | Salmon et al. . | |
| 3,301,111 | 1/1967 | Nystrand . | |
| 3,589,709 | 6/1971 | Hey et al. . | |
| 3,627,304 | 12/1971 | Reeder et al. . | |
| 3,640,521 | 2/1972 | Hutley | 270/39 |
| 3,684,275 | 8/1972 | Schweitzer et al. . | |
| 3,724,838 | 4/1973 | Orlovsky . | |
| 3,746,142 | 7/1973 | Hepp et al. . | |
| 3,820,700 | 6/1974 | Quirijnen . | |
| 3,858,476 | 1/1975 | DeLigt . | |
| 3,897,051 | 7/1975 | Muller . | |
| 3,913,904 | 10/1975 | Occhetti . | |
| 3,937,452 | 2/1976 | Gath . | |
| 3,991,993 | 11/1976 | Clouthier . | |
| 4,068,566 | 1/1978 | Joice . | |
| 4,118,022 | 10/1978 | Rayfield et al. . | |
| 4,134,559 | 1/1979 | Dyllus et al. . | |
| 4,190,242 | 2/1980 | Bolza-Schunemann . | |
| 4,205,836 | 6/1980 | Nystrand . | |
| 4,216,705 | 8/1980 | Achelpohl et al. . | |
| 4,223,882 | 9/1980 | Stocker . | |
| 4,261,497 | 4/1981 | Roetter et al. . | |
| 4,269,401 | 5/1981 | Sargis et al. . | |
| 4,296,684 | 10/1981 | Wangermann . | |
| 4,401,428 | 8/1983 | Thomas et al. . | |
| 4,406,650 | 9/1983 | Felix . | |
| 4,412,637 | 11/1983 | Berger . | |
| 4,460,350 | 7/1984 | Mittal et al. . | |
| 4,487,645 | 12/1984 | Weston . | |
| 4,507,109 | 3/1985 | Meschi . | |
| 4,508,527 | 4/1985 | Uno et al. . | |
| 4,573,409 | 3/1986 | Char et al. . | |
| 4,573,670 | 3/1986 | Felix . | |
| 4,577,789 | 3/1986 | Hoffmann et al. . | |
| 4,578,052 | 3/1986 | Engel et al. . | |

(List continued on next page.)

FOREIGN PATENT DOCUMENTS

| | | | |
|---|---|---|---|
| 2506901 | 8/1975 | Fed. Rep. of Germany | 493/413 |
| 102367 | 6/1985 | Japan | 270/31 |
| 171969 | 9/1985 | Japan | 270/31 |
| 8803121 | 5/1988 | PCT Int'l Appl. | 270/31 |
| 8803509 | 5/1988 | PCT Int'l Appl. | 270/31 |
| 988080 | 4/1965 | United Kingdom | 493/415 |

OTHER PUBLICATIONS

*IBM Technical Brochure*, "Paper Forms Folder Feed Drive", Chaplin, vol. 14, No. 3, Aug. 1971.

*Primary Examiner*—Edward K. Look
*Assistant Examiner*—Therese M. Newholm
*Attorney, Agent, or Firm*—Killworth, Gottman, Hagan & Schaeff

[57] ABSTRACT

An apparatus and method for separating and folding forms cut from a continuous web is provided wherein a swing chute having opposing first and second conveying surfaces positively conveys a form to a delivery table, maintaining control of the form until the trailing edge exits therefrom. The apparatus includes a swing chute for use in a dynamic or zig-zag folding apparatus.

58 Claims, 7 Drawing Sheets

U.S. PATENT DOCUMENTS 4,593,893 6/1986 Suter .
4,610,649 9/1986 Friess .
4,618,340 10/1986 Meschi .
4,623,136 11/1986 Bunch ..... 270/39
4,650,447 3/1987 Meschi .
4,673,382 6/1987 Buck et al. .
4,688,708 8/1987 Irvine et al. .
4,702,135 10/1987 Kwasnitza .
4,708,332 11/1987 Besemann .
4,718,654 1/1988 Ehlers .
4,721,295 1/1988 Hathaway .
4,725,051 2/1988 Parr .
4,729,812 3/1988 Meschi .
4,730,762 3/1988 Felix .
4,751,879 6/1988 Van Pelt .
4,781,090 11/1988 Feldkamper et al. .
4,824,426 4/1989 DuFresne .
4,828,540 5/1989 Fordyce ..... 493/415
4,842,572 6/1989 Roth .
4,846,454 7/1989 Parkander ..... 270/39
4,928,940 5/1990 Dash .

APPARATUS AND METHOD FOR FOLDING SEPARATED FORMS IN A STACK

BACKGROUND OF THE INVENTION

The present invention relates to an improved apparatus and method for separating and folding sections of a continuous web, in particular, to folding forms of two or more pages produced from a continuous web. The present invention further relates, in particular, not only to folding forms which have been cut from a continuous web along a perforated or weakened line of folding, but also to those which have been cut slightly offset from a Perforated or weakened line of folding, and thereby have a tail which can be used to identify and separate the folded form from a stack.

The development of high speed printers has been accompanied by the development of improved devices to separate and fold sections of continuous webs containing forms, printouts and reports. Multi-page web sections, forms, printouts, reports and the like are, as a group, referred to herein as forms, and a page is defined as extending between adjacent perforated or weakened lines of folding in a form or continuous web. Known devices which separate continuous webs prior to folding include the Model 7500 Forms Folder with Job Sort available from the Standard Register Co., Dayton, Ohio. These cutter/folder devices transversely cut rapidly moving continuous webs from high speed printers into forms of two or more pages by means of a rotary cutter, and may produce such forms with a tail or tab extending from a perforated line.

Problems have arisen in folding short forms, defined herein as a form of from two to nine pages, particularly two page forms, produced on devices such as the Model 7500 Forms Folder. By virtue of their design, the outfeed gripper rollers typical of such devices positively feed forms into a swing chute for folding, but relinquish positive control of short forms as the trailing end enters the swing chute, before folding is sufficiently underway. As a result, the process of folding short forms has relied on the swing action of the swing chute in combination with frictional engagement between the leading page of the form with the delivery table or with an existing stack of forms thereon. Spirals, knockdown fingers and fluted rollers, which contact forms exiting the swing chute, help initiate folding and provide some control of short forms; however, the short length of short forms also limits the effectiveness of these devices.

One such folding arrangement is shown by Felix, U.S. Pat. No. 4,730,762. Incompletely or poorly folded short forms still result, interfering with the folding and stacking of subsequently issuing forms, and jamming the folding apparatus. These problems have been experienced with three to nine page forms, as well, but with less frequency as the forms become longer. It has been found that as forms become longer, control of the forms is maintained with outfeed gripper rollers, as the rollers are able to positively feed the form through the swing chute and onto the delivery table during folding. This causes the swing chute, spirals and knockdown fingers to more effectively initiate and complete folding of the form. With longer forms, the weight of the stack forming on the delivery table tends to promote correction by flattening misaligned and misfolded forms near the bottom of the stack, and by anchoring the leading edge of incoming forms.

Thus, while improved separating devices can cut forms as short as two pages, folding and stacking of short forms has remained problematic. To avoid such problems, where runs of short forms are desired, additional blank pages have been added to accommodate existing folding apparatuses. This undesirably wastes significant amounts of paper which also must be manually detached from the desired portion of the form.

Other known methods and apparatuses for folding are typically designed to first fold continuous webs into multi-page stacks. Then, the stack of folded forms is severed from the web upon reaching a given number of pages or a predetermined height, as shown, for example, by Kwasnitza U.S. Pat. No. 4,702,135 and Meschi U.S. Pat. No. 4,618,340. Such devices are not designed to accommodate successive short forms arriving from high speed printers and, moreover, include components which are most effective in folding longer forms or continuous webs.

Among the applications that are the most difficult for cutting and folding forms is the intermittent operation of high speed printers at continuously changing speeds, typically from substantially 0.0 feet per minute to 300 feet per minute, but which may reach 500 feet per minute. Such operation requires similar responsive action by form handling devices operating therewith, such as the cutter/folder devices described, and exacerbates folding and stacking problems encountered with short forms.

Accordingly, further improvements are needed to satisfy the demand for more efficient folding apparatuses for high speed devices to fold consecutive short forms cut from a continuous web. If proper folding of short forms is repeatably performed, problems with stacking and jamming of the folder encountered with existing devices may be avoided, and the need to add and then manually separate blank pages from short forms to accomplish folding may be eliminated.

SUMMARY OF THE INVENTION

The present invention meets those needs by providing an apparatus which may be used with high speed printers to fold continuous webs, and fold both multipage forms and short forms cut from a continuous web. Webs and forms, particularly short forms, may reliably and repeatedly be folded in the present invention.

The present invention comprises a form handling device, such as a cutter/folder, which includes means for folding, and in particular, to a swing chute for use in a dynamic or zig-zag folding apparatus. The swing chute in the present invention includes a means for positively conveying which receives and positively conveys webs and forms therethrough onto a means for receiving, such as a delivery table, for stacking. To convey webs and forms positively, the swing chute includes opposing first and second conveying surfaces disposed on a swing chute frame to receive and then frictionally engage webs and forms between the two conveyor surfaces, thus controlling webs and forms therein. Preferably, those surfaces define a funnel-like chute, open at the top and narrowing near the bottom. Other shapes, however, are possible. The conveying surfaces are each comprised of two or more rotatable rollers, preferably three, on which at least one, and preferably a plurality of, endless belts are disposed. At least one, and preferably two rollers of each conveying surface further preferably include a plurality of outwardly tapered segments thereon, each engaging one of the plurality of endless belts, to retain the spacing of endless belts across the conveying surfaces. The endless belts are adapted to frictionally contact forms, and further, preferably, intermesh slightly with those of the opposing surface as the first and second conveying surfaces draw closer together near the bottom of the swing chute. As a result of this preferred structure, the conveying surfaces temporarily impart a slight corrugating effect to the web or form, momentarily stiffening the form, and enhancing its outfeed to the delivery table. Both pre-folded and previously unfolded continuous webs and forms may be folded in the form handling device of the present invention.

The combination of swinging action and the positive conveyance of webs and forms from the swing chute onto the delivery table provides control over webs, multipage forms and, particularly, short forms, effecting folding thereof. Control maintained over short forms enables the device to repeatably and reliably initiate the folding process. The swing chute itself grips the form until the trailing end of the form exits the swing chute. At this time the folding action has substantially been initiated and further control has been exerted by additional elements such as knockdown fingers, spirals, fluted rollers and stops.

The swing chute of the present invention operates at speeds timed in relation to the advance of a web or form in the form handling device by connecting to power and power transmission means in common with the means for advancing the web or form in the device. Swinging action of the chute is established by a reciprocating arm which swings the swing chute along a pivot axis in an arc. The size of the arc is related to the size of pages on a web or form, and defines a swing angle. The position of the chute through the swing angle is related to the position of a web or form advancing through the form handling device. The speed of rotation of opposing first and second conveying surfaces is coordinated with the advance of the web or one or more forms in the form handling device, preferably coordinated with the advance of a web or form into the swing chute. A drive shaft connects the conveying surfaces to a source of rotary power. For simplicity, the drive shaft is preferably disposed along the pivot axis in which the swing chute swings. It has been found that because of relative motion existing between the swinging swing chute and the drive shaft, drive shaft rotation must be adjusted to prevent acceleration and deceleration which is otherwise induced upon the conveying surfaces by the swinging action of the swing chute. The present invention thus incorporates a novel pulley and gear assembly to effect such adjustment. Thus, when webs and forms advance at constant speed through the device of the present invention, the swing chute will operate to convey webs and forms therethrough at substantially the same constant speed. Where the rate of advance of a form in the form handling device varies, the rate at which the swing chute swings and the speed at which the conveying surfaces rotate correspondingly varies.

A further aspect of the present invention comprises the swing chute itself, adapted to receive and positively convey forms, particularly short forms. That is, the swing chute can advantageously be separately incorporated into many form handling devices which incorporate dynamic or zig-zag folders. Without intending to limit the scope of such applications, the swing chute may be incorporated, for example, into conventional bursters or into cutter/folders which first fold continuous webs into a stack and then insert a knife into the stack to sever the folded web into individual stacks or separate adjacent forms within a stack.

Finally, a further aspect of the present invention is a method for advancing and controlling a form of two or more pages comprising the steps of: advancing a web or form in a form handling device into a swing chute; positively conveying said web or form with said swing chute onto a means for receiving for folding; and folding said web or form thereon in timed relation with the advance of said web or a form in said form handling device.

DETAILED DESCRIPTION OF THE PREFERRED EMBODIMENT

Figures 1, 2:
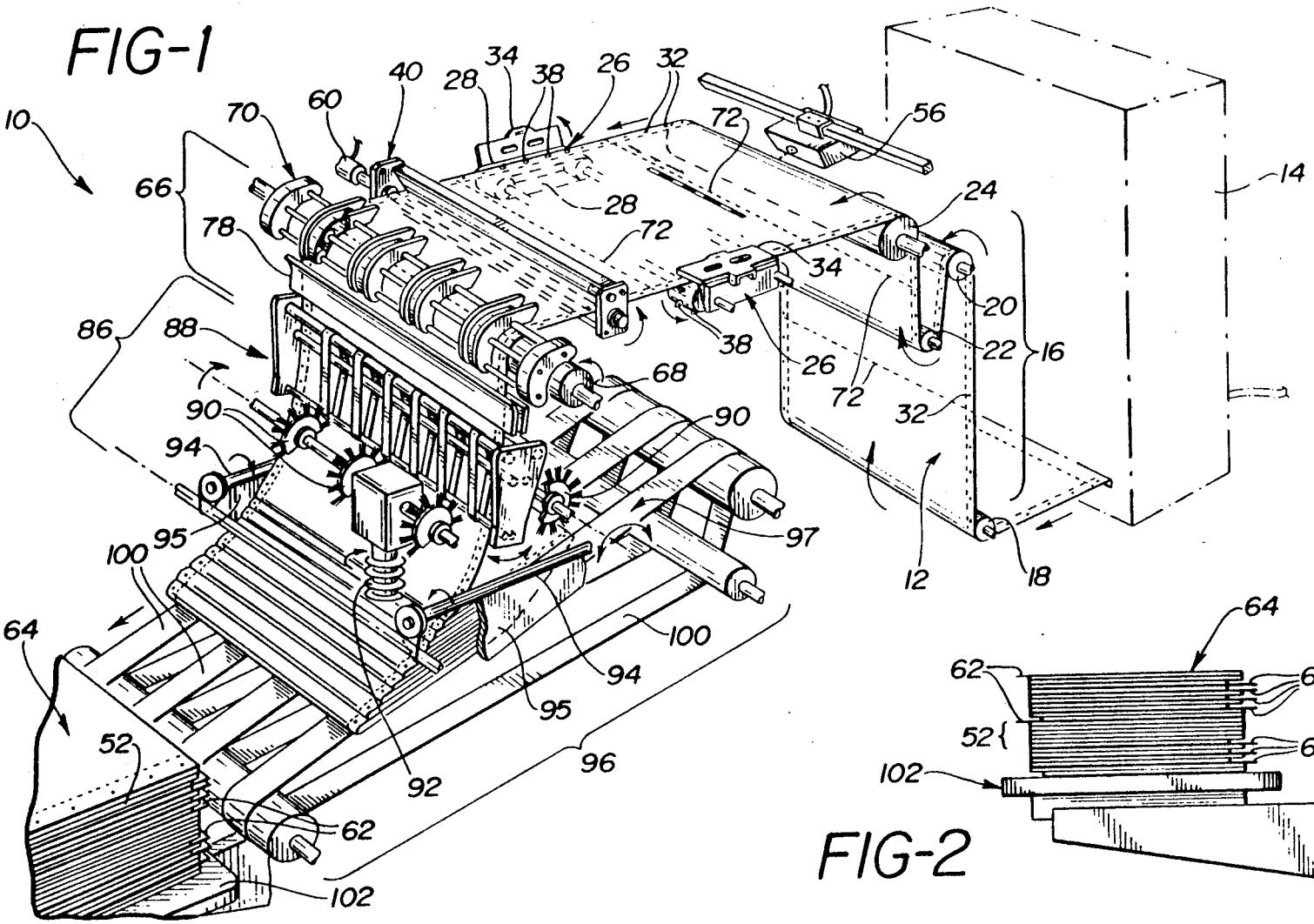
FIG. 1 is a perspective schematic view of the present invention.
FIG. 2 is an elevational view of a representative stack of forms folded with the present invention.

Referring to FIG. 1, in accordance with the present invention, a form handling device 10 for separating and folding forms from a continuous web is shown. FIG. 1 schematically illustrates the relationship and operation of the various elements of the present invention in a cutter/folder of otherwise known construction. For simplicity of illustration, the supporting frame means 11 of device 10 has been omitted from FIG. 1, and is shown representatively in FIGS. 3-5, 7 and 8. Means for advancing a continuous web 12 and forms 52 through device 10 are shown in FIG. 1 and include an infeed roller assembly 16, pinfeed assembly 26 and outfeed assembly 66. Device 10 also includes rotary cutter 40 operable by known sensor and control means 56, 60 for transversely severing web 12, output from high speed printer 14, into short or multi-page forms 52. Web 12 may also pass through rotary cutter 40 without cutting. As shown in FIGS. 1 and 2, a tail 62 may be created by transversely cutting web 12 offset from perforated lines 72 at various lengths. Web 12 and forms 52 are advanced through device 10 into means for folding 86 which includes the swing chute 88 of the present invention.

More specifically, in device 10 as shown in FIG. 1, continuous web 12 output from high speed printer 14 is pulled through infeed roller assembly 16 by pinfeed assemblies 26. Infeed roller assembly 16 is comprised of idle roller 18, idle guide roller 20, speed dancer roller 22, and infeed roller 24 as are known in the art. Still referring to FIG. 1, each pinfeed assembly 26 includes a pin-belt 28 having pins 38 which pull continuous web 12 into apparatus 10. Pins 38 are thrust through holes 32 in the margins of continuous web 12, which is retained thereon with top guides 34, shown in open and closed positions. Pinfeed assemblies 26 are also used to initially register continuous web 12 in device 10 along a perforated line 72, and maintain the alignment of continuous web 12 as it is pulled through infeed roller assembly 16. The position of other components, such as a swing chute, may be set by reference to the registration of web 12 in device 10. Infeed roller 24 and pin-belts 28 are rotated at complementary speeds by motor 36 and mechanical transmission 37 (see FIG. 3).

Figure 3:
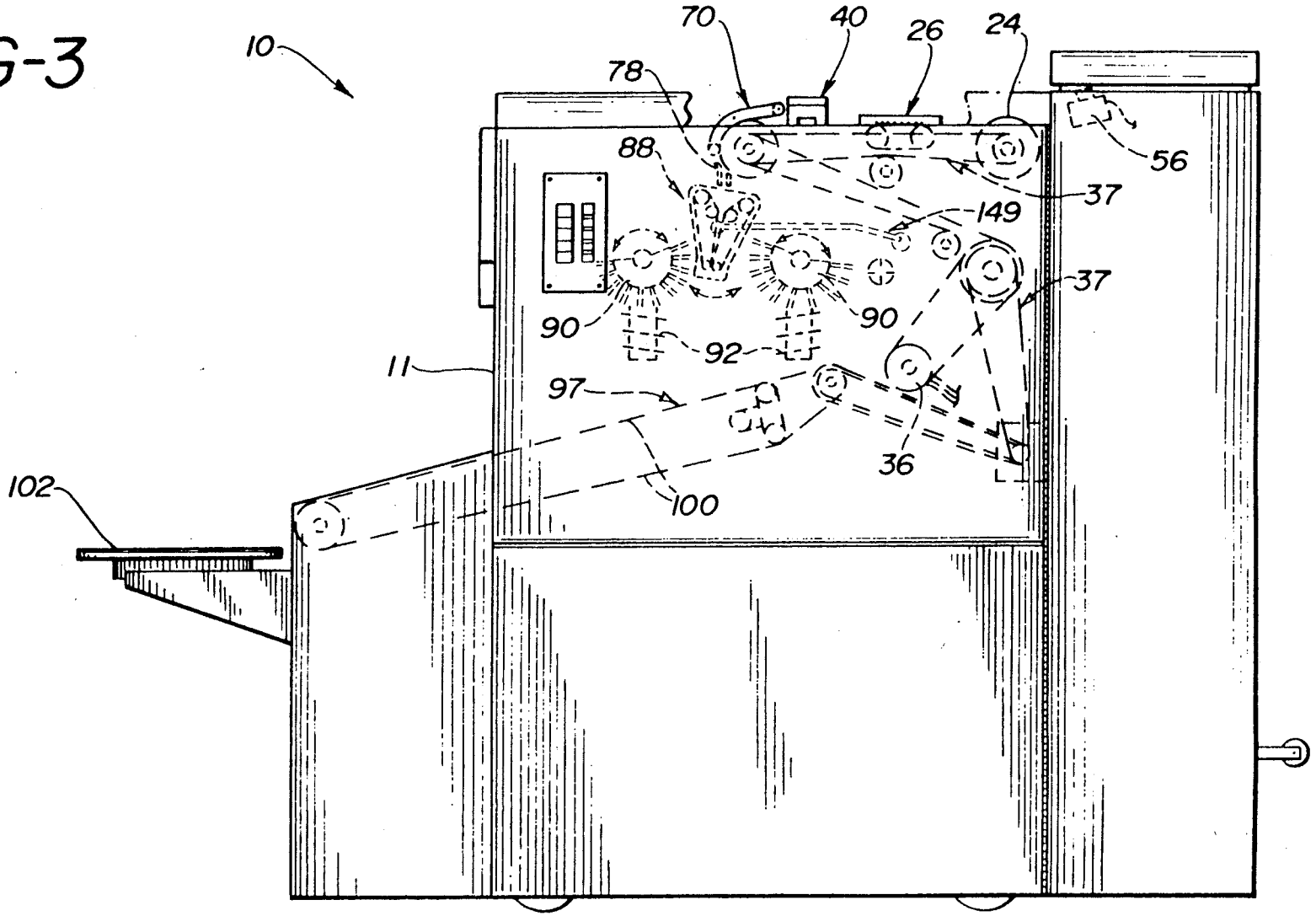
FIG. 3 is a side elevational view of the present invention.
Figure 4:
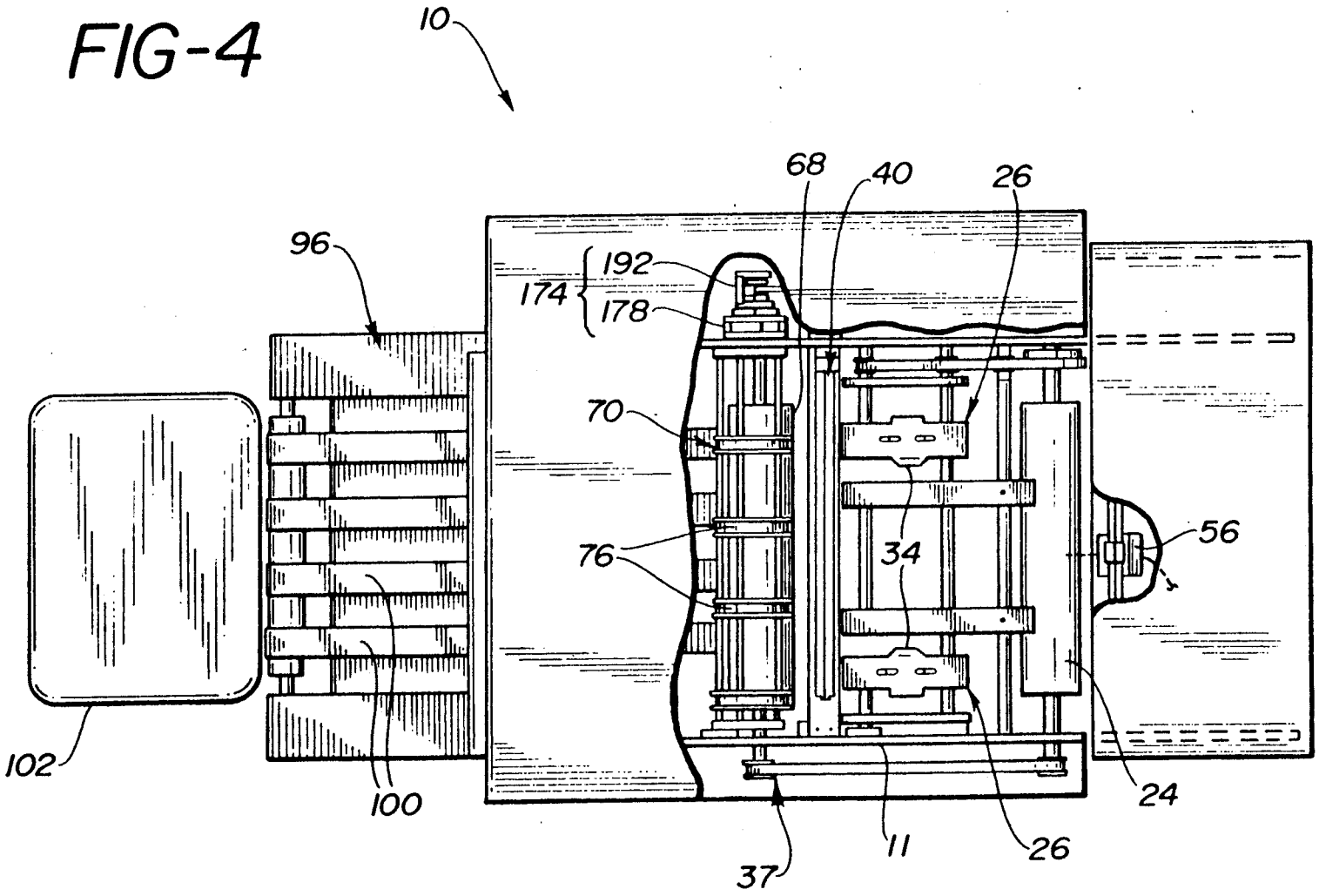
FIG. 4 is a top view of the present invention.

Best seen in FIGS. 1 and 3, outfeed assembly 66 comprises hold-down assembly 70 and pull roller 68. Pull roller 68 and hold-down assembly 70 initially contact and frictionally retain the leading edge of continuous web 12 therebetween, turning it 90 degrees and feeding it into means for folding 86. Alternatively, fixed chute 78 may be included to further guide continuous web 12 into means for folding 86. Thus, by the time the trailing end of a form 52 is formed by severing continuous web 12, the leading edge of form 52 has already been received by outfeed assembly 66 and is at some point along the path just described. Pull roller 68 may be driven slightly overspeed relative to pinfeed assemblies 26 to provide slight tension on continuous web 12 to facilitate rotary cutting, ensure separation of severed forms 52 from continuous web 12, and avoid jamming. Also connected to motor 36 and mechanical transmission 37, pull roller 68 rotates hold-down assembly by frictional surface contact therewith.

Having representatively described the general operation of device 10, typical of rotary cutter/folders for use with high speed printers which advance webs 12 or forms 52 into means for folding 86, the operation of the swing chute 88 of the present invention, preferably embodied in such device, is described in greater detail. As shown in FIG. 1, in the present invention, means for folding 86 comprises a swing chute 88 and means for receiving 96, whereon web 12 or forms 52 are folded. Swing chute 88 of the present invention, best shown in FIGS. 3, 5 and 6, includes a means for positively conveying which receives and positively conveys web 12 and forms 52 therethrough. Means for positively conveying includes opposing first and second conveying surfaces 112, 114, respectively. Opposing first and second conveying surfaces 112, 114 are disposed on swing chute frame 116, defining a funnel-like chute.

Figure 5:
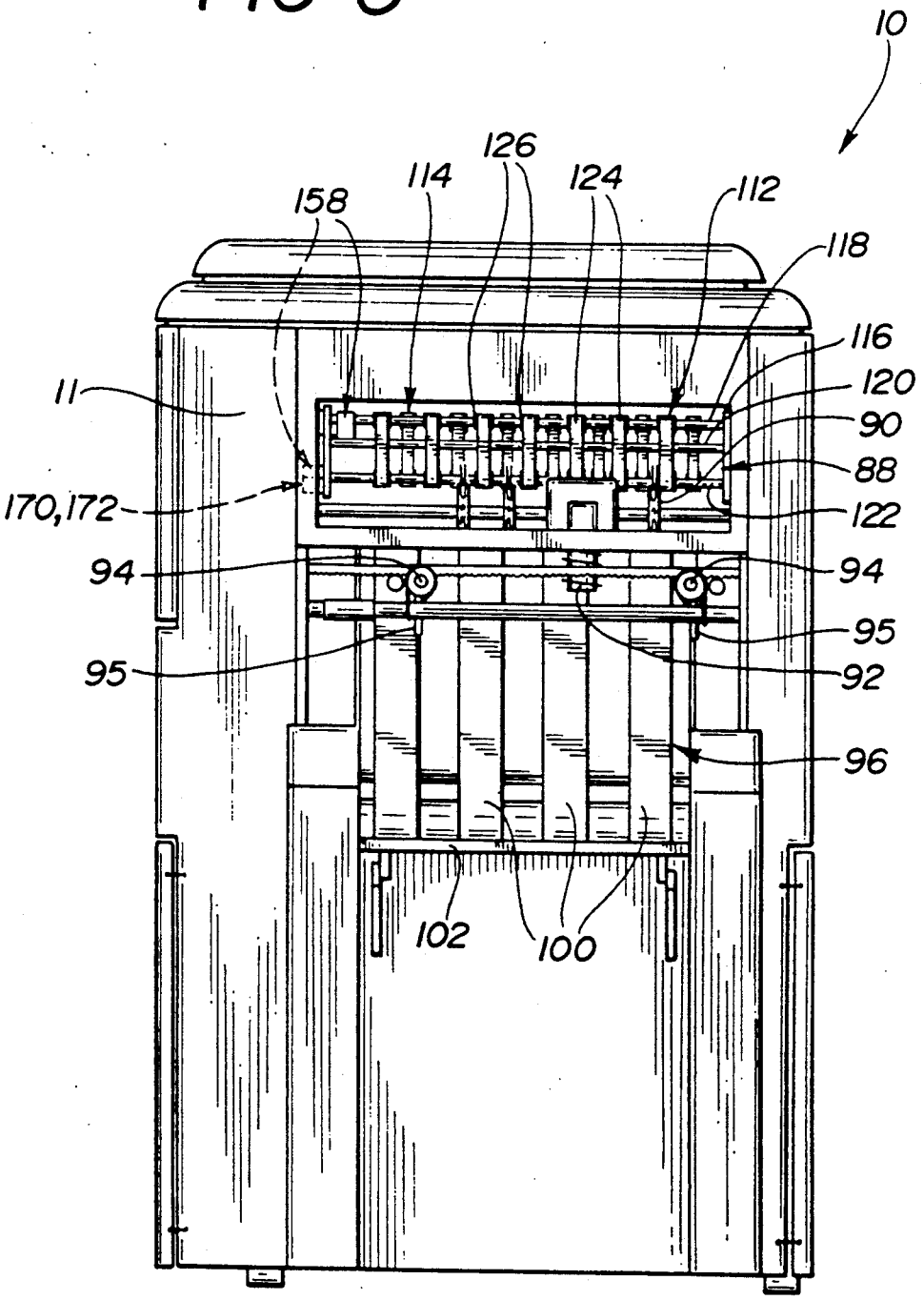
FIG. 5 is an outfeed-end view of the present invention showing portions of the means for folding including the swing chute, and a delivery and stacker table.
Figure 6:
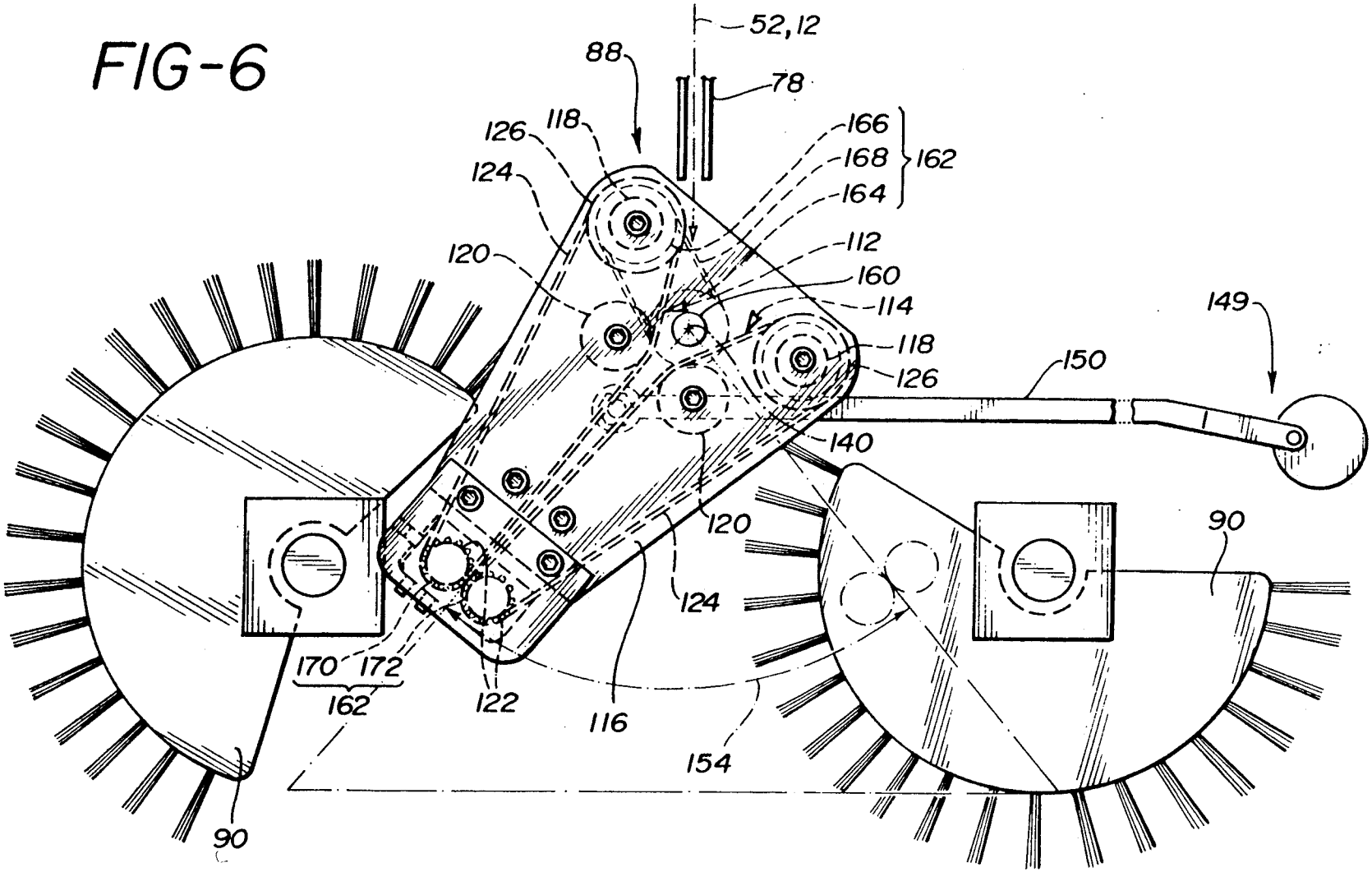
FIG. 6 is an enlarged side elevational view of the swing chute of the present invention as shown in FIG. 3.

Shown best in FIG. 6, the first and second conveying surfaces 112, 114 are each defined by three or more, preferably three, rotatable rollers 118, 120, 122 supporting one or more, preferably a plurality, of endless belts 124. At least one roller 118, 120 or 122 and preferably two 118, 122, on each conveying surface 112, 114, preferably further include a plurality of outwardly tapered segments to help hold endless belts 124 in place. As seen in FIG. 5, conveyor pulleys 126 which attach to rollers 118 include such tapered segments. Whether on pulleys 124 or made in relief directly on the roller, such tapered segments each engage one of the plurality of endless belts 124. Endless belts 124 of first and second conveying surfaces 112, 114 frictionally contact web 12 and forms 52 entering swing chute 88. First and second conveying surfaces 112, 114 intermesh slightly as they draw closer together near the bottom of swing chute 88, as seen in FIGS. 1 and 6. As a result of this structure, first and second conveying surfaces 112, 114 temporarily impart a slight corrugating effect to web 12 or form 52, enhancing the control over webs 12 and forms 52, which is particularly helpful in folding short forms.

Figure 7:
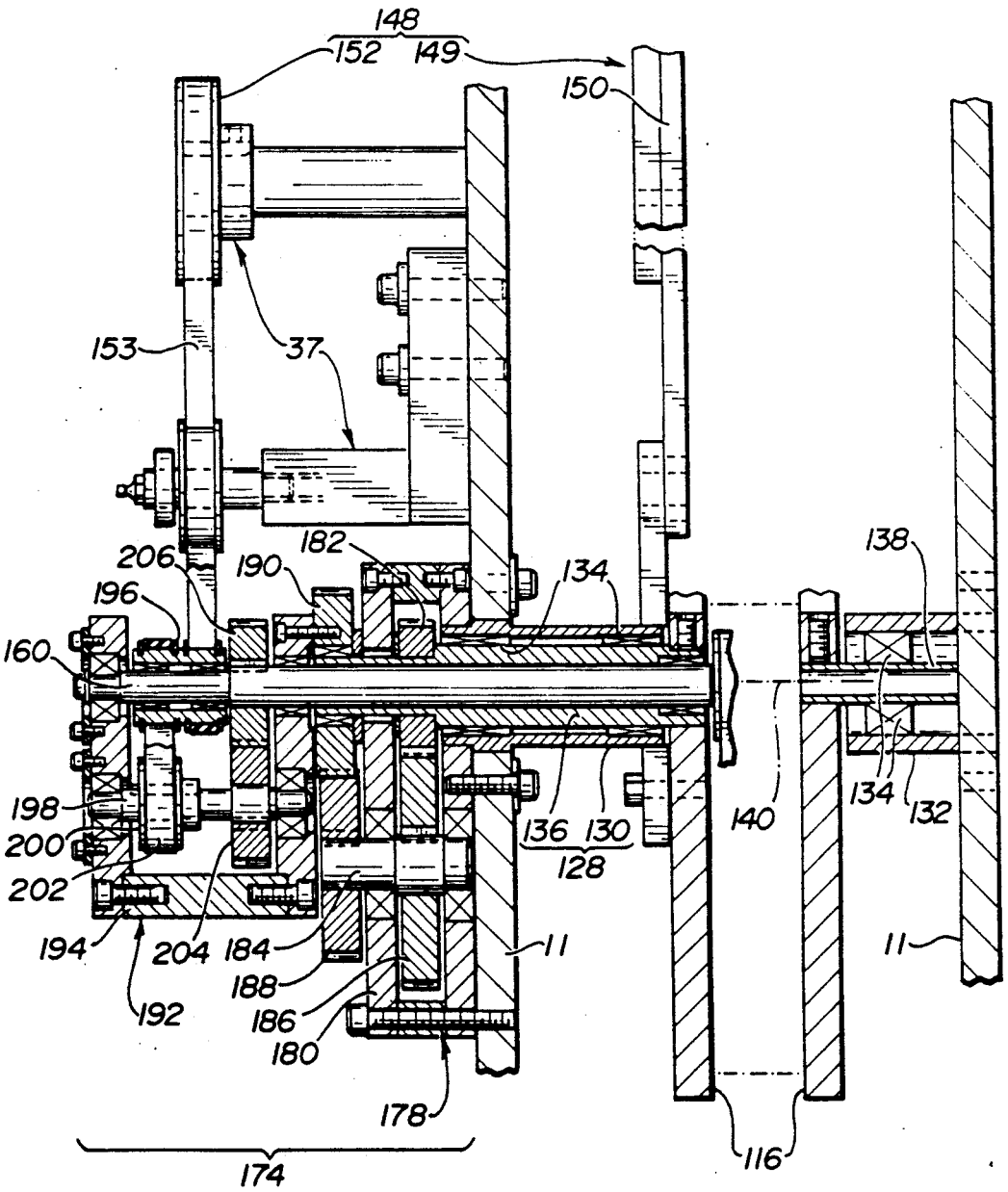
FIG. 7 is an enlarged cross section of the means for driving the drive shaft and means for rotating the conveyor surfaces of the swing chute shown in the top view of FIG. 4.

Referring to FIG. 7, means for mounting 128 are shown which enable swing chute 88 to swing in an arc. Means for mounting 128 comprises first and second sleeves 130, 132 fixed to opposite sides of frame means 11, and first and second tubes 136, 138 which are rotatably disposed in first and second sleeves 130, 132, respectively. First and second tubes 136, 138 are attached to opposing first and second ends of swing chute frame 116, respectively. Preferably, bearing assemblies 134 known in the art are inserted between sleeves 130, 132 and tubes 136, 138 to facilitate free swinging action of chute 88. Means for mounting 128 thereby define a pivot axis 140 along which swing chute frame 116 swings.

Still referring to FIG. 7, means for operating 148 are shown which operate swing chute 88 at speeds timed in relation to the advance of a web 12 or one or more forms 52 in device 10. Preferably the speed is timed in relation to the advance of web 12 or form 52 into outfeed assembly 66, and may be driven slightly overspeed along with outfeed roller 168 typically approximately 1% overspeed. Such timing is preferably achieved by interconnecting means for operating 148 with mechanical transmission 37, shown in part in FIGS. 3 and 7 which also drives various means for advancing, such as infeed assembly 16, pinfeed assembly 26 and outfeed assembly 66 as shown in FIG. 1. Means for operating 148 swing chute 88 includes means for swinging 149, such as a reciprocating pivot arm 150 attached to swing chute 88 and driven by an excentric wheel; and a source of rotary power 152, which powers means for rotating first and second conveying surfaces 112, 114. Means for swinging 149 swings swing chute 88 through an arc related to the size of pages on web 12 or form 52, and defines swing angle 154. For example, in the present invention swing angle 154 is substantially 78 degrees for a web 12 or form 52 having pages 8½ inches long. It is understood that the swing angle can be determined by trial and error for different page sizes. The position of swing chute 88 in the arc may be adjusted to relate to the position of web 12 or form 52 as it advances through device 10 into means for folding 86. The position may be initially set with reference to the position of a perforated line 72 in web 12 when registered in pinfeed assemblies 26.

Figure 8:
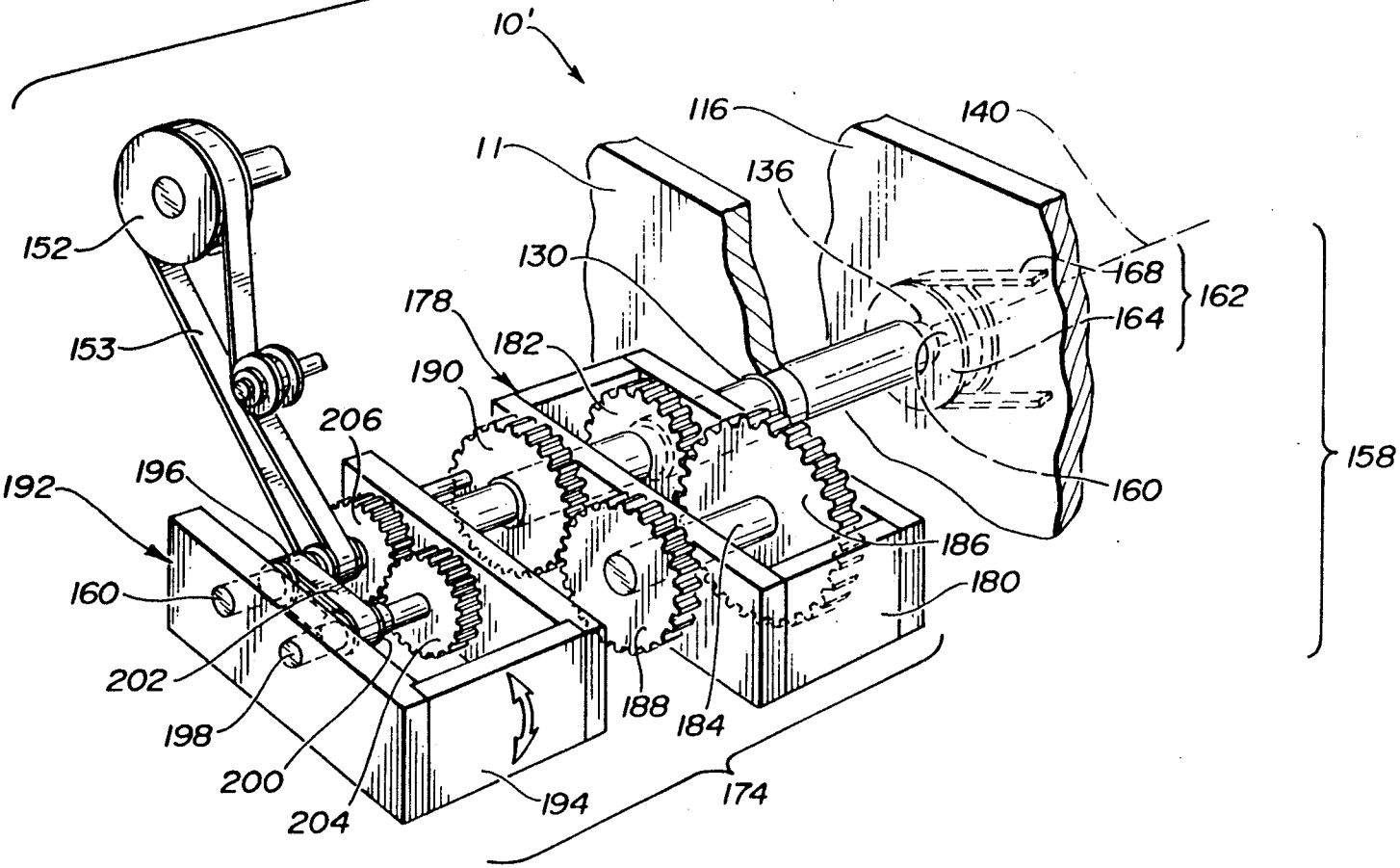
FIG. 8 is a partially exploded perspective view of the means for driving the drive shaft of FIG. 7.

Means for rotating 158 first and second conveying surfaces 112, 114, best shown in FIG. 6, comprises a rotatable drive shaft 160 having a first and second end; means for connecting 162 drive shaft 160 at its first end to at least one of the first and second conveying surfaces 112, 114; and means for driving 174 drive shaft 160 connected at its second end to source of rotary power 152. Referring now to FIGS. 6, 7 and 8, drive shaft 160 is preferably disposed along pivot axis 140, extending through means for mounting 128. Means for connecting 162 drive shaft 160 to first and second conveying surfaces 112, 114 preferably comprises a first pulley 164 attached to the first end of drive shaft 160, a second pulley 166 attached to first conveyor surface 112 at roller 118, and conveyor drive belt 168 engaged in first and second pulleys 164, 166. Shown in FIG. 6, means for connecting 162 further includes first and second transmission gears 170, 172 attached to first and second conveying surfaces 112, 114, respectively, at rollers 122 to rotate both surfaces in opposite directions at the same speed. Alternatively, second conveying surface 114 could be driven by a gear arrangement, or a gear and pulley arrangement directly connected to drive shaft 160.

As seen in FIGS. 7 and 8, means for driving 174 drive shaft 160 requires more than a simple connection to source of rotary power 152. Due to relative motion between swing chute 88, as it swings through an arc, and drive shaft 160, the rotation of drive shaft 160 must be adjusted to prevent acceleration and deceleration of first and second conveying surfaces 112, 114 which is otherwise induced by the swinging action. With reference to FIG. 6, such relative motion may be understood by considering the effect of swinging swing chute 88 while holding drive shaft 160 fixed. First and second conveying surfaces 112, 114, would respond by alternately rotating forwards and backwards as swing chute 88 moves through an arc. Means for driving 174 drive shaft 160 adjusts for the effect of such motion, alternately increasing and decreasing the rotation imparted to drive shaft 160. Such adjustment eliminates any relative motion between first and second conveying surfaces 112, 114 and swing chute from 116 arising simply from swinging swing chute 88. Shown in FIGS. 7 and 8, means for driving 174 comprises pulley and gear assembly 176 having a fixed first gear box 178 rigidly attached to frame means 11 and a movable second gear box 192.

First gear box 178 comprises a first gear box frame 180 wherein a plurality of gears oscillate in time with swing chute 88. First gear 182 is disposed in first gear box 178 and is rigidly connected to means for mounting 128. Specifically, first gear 182 is rigidly connected to first tube 136, which connects to swing chute frame 116. First gear 182 thereby oscillates through swing angle 154 along pivot axis 140 in concert with swing chute frame 116. A first axle 184 is also rotatably disposed in first gear box frame 180, parallel to means for mounting 128 and pivot axis 140. First axle 184 extends from a first end mounted in first gear box frame 180 to a second end outside gear box frame 180. Second gear 186 is rigidly mounted near the first end of first axle 184, preferably is twice the diameter of first gear 182, and intermeshes with first gear 182. As a result of its diameter, second gear 186 oscillates through substantially one-half of swing angle 154.

Third gear 188 is also rigidly connected to first axle 184, but at its second end outside of first gear box frame 180. Third gear 188 oscillates in concert with second gear 186 through substantially one-half of swing angle 154. Preferably, third gear 188 has substantially one and one-half the diameter of first gear 182. Fourth gear 190, having substantially the same diameter as third gear 188, is disposed outside and adjacent to first gear box frame 180 along pivot axis 140, mounted on first tube 136 and is freely rotatable thereon. Fourth gear 190 intermeshes with third gear 188 to oscillate through substantially one-half of swing angle 154. Fourth gear 190 is further rigidly attached to movable second gear box 192. Alternatively, oscillation of second gear box 192 through substantially one-half swing angle 154 may be accomplished where first and second gears 182, 184 have the same diameter and fourth gear 190 has twice the diameter of third gear 188. Numerous other gear size combinations are possible to make second gear box 192 oscillate through one-half of swing angle 154.

Second gear box 192 comprises a second gear box frame 194 to which fourth gear 190 attaches, and further includes a number of gear and pulley elements further described below. Second gear box frame 194 is disposed in part along pivot axis 140 and mounted on drive shaft 160, but is freely rotatable thereon. Thus, while drive shaft 160 rotates, second gear box frame 194 may be caused to oscillate through substantially one-half of swing angle 154 by action of fourth gear 190. In second gear box 192, idler pulley 196 is also disposed on drive shaft 160, and is freely rotatable thereon. Idler pulley 196 is rotatably driven by source of rotary power 152, preferably by means of a power drive belt 153.

A first drive axle 198 having first and second ends is rotatably mounted in second gear box frame 194 parallel to drive shaft 160 and pivot axis 140. Drive pulley 200 is rigidly connected to the first end of first drive axle 198. Idler pulley 196 and drive pulley 200 engage drive belt 202 which, with power drive belt 153, conveys rotary power from source of rotary power 152 to first drive axle 198. A first drive gear 204 disposed in second gear box 192 is rigidly connected to the second end of first drive axle 198 and intermeshes with a second drive gear 206 which is rigidly connected to drive shaft 160. Rotary motion from source of rotary power 152 is thereby imparted to drive shaft 160. The effect of this arrangement is to allow the transmission of rotary motion to drive shaft 160 to be varied in timed coordination with swing chute 88 to compensate for the swinging motion of swing chute 88. As second gear box frame 194, connected to fourth gear 190, is oscillated through one-half of swing angle 154, first drive gear 204 swings in planetary fashion (as indicated in FIG. 8) about second drive gear 206, alternately increasing and decreasing the rotational motion it imparts to drive shaft 160.

While folding of a web 12 is possible with only swing chute 88 and means for receiving 96, it is preferable to further include one or more of knockdown fingers 90, spirals 92 and fluted rollers 94 in means for folding 86. These additional elements shown in FIG. 1 may be included individually or in combination to further urge web 12 or forms 52 cut therefrom to fold. In operation, forms 52 emerge from swing chute 88 as it approaches an end point of the arc in which it swings. The leading edge and subsequent perforated lines 72 of web 12 or form 52 are urged towards spirals 92 by knockdown fingers 90. Spirals 92 and knockdown fingers 90 along with the action of swing chute 88 initiate folding and control back to back motion of forms 52. Spirals 92, rotating as indicated in FIG. 1, both act as a stop and urge the pages of forms 52 to fold downward along perforated lines 72. Fluted rollers 94, rotating as shown in FIG. 1, contact the edges of folded forms 52 both urging them to fold and to compact towards means for receiving 96.

Means for receiving 96, in its simplest embodiment, comprises a delivery table 97 which provides a surface for stacking. Preferably, however, means for receiving 96, as shown in FIG. 1 incorporates additional elements. For example, box 95 having two or more side walls may be added to control side to side motion of forms 52 and stack of forms 64 building on delivery table 97. Delivery table 97 may be tilted, preferably at substantially 15 degrees, and a plurality of rotatable endless delivery belts 100 included to move forms 52 and folded wet 12 at preferably 0.0 to generally 1.5 feet per minute towards stacker table 102, depositing them there in vertically oriented stacks 64. Stacker table 102 may raise and lower automatically as known in the art as stacks 64 form and a re removed. The manner of connection of elements and materials and the construction and connection of motor 36 and mechanical transmission 37 used in the present invention are in other respects conventional as known in the art.

In a further aspect of the present invention, swing chute 88, separate from the embodiment in device 10 set forth above, may be incorporated in any number of form handling devices 10', indicated generally in FIG. 8. In such an embodiment like numbers would represent like elements. As would be necessary to practice the invention, it is understood that form handling device 10' would comprise at least a supporting frame means 11, and means for advancing web 12 or forms 52 into means for folding 86; and have a powered means for swinging 149 swing chute 88 and, a source of rotary power 152. It is further understood that the means for swinging 149 and source of rotary power 152 may be coordinated in timed relationship with said means for advancing as aforesaid.

A further aspect of the present invention is a method for folding separated forms 52 in a stack 64, which comprises a series of steps beginning with advancing a continuous web 12 having perforated lines 72 to a rotary cutter 40. In rotary cutter 40 web 12 is transversely severed along transverse cut lines made at perforated lines 72. Forms 52 of two or more pages made thereby advance from rotary cutter 40 into means for folding 86. Means for folding 86 then positively conveys forms 52 onto means for receiving 96 whereon forms 52 are folded along all perforated lines 72.

A further method for separating folded forms 52 in a stack 64 provides for first advancing a continuous web 12 having perforated lines 72 to a rotary cutter which transversely severs web 12 along transverse cut lines offset from perforated lines 72. Forms 52 of two or more pages made thereby, have tails 62. Forms 52 are thereafter advanced from rotary cutter 40 into means for folding 86. Means for folding 86 then positively conveys forms 52 onto means for receiving 96 whereon forms 52 are folded along all perforated lines 72 except that one which is adjacent the transverse cut line forming tail 62.

Both methods further preferably provide for the additional step of imparting a generally corrugated shape to form 52 when positively conveying forms 52 in means for folding 86. As well, additional steps may be added for conveying forms 52, folded on means for receiving 96, to stacker table 102; and for separating stacked forms 52 by reference to tails 62 thereof. These methods apply equally to forms 52 and a web 12.

While certain representative embodiments and details have been shown for purposes of illustrating the invention, it will be apparent to those skilled in the art that various changes in the apparatus, method and article disclosed herein may be made without departing from the scope of the invention, which is defined in the appended claims.

What is claimed is:

1. A form handling device for advancing and folding a continuous web and forms of two or more pages, said form handling device comprising:

means for advancing a continuous web and forms in a direction of web movement;

means for folding said web and forms comprising:

a swing chute adapted to swing through an arc defining a swing angle, said swing chute including means for positively conveying said web and forms therethrough, said means for positively conveying disposed in said swing chute and operable to positively convey said web and forms at a speed substantially related to the advance of said web and forms in said direction of web movement, said speed substantially unrelated to the position of said swing chute as it swings through said arc;

means for receiving said web and forms from said swing chute whereon said web and forms are folded; and means for operating said means for folding in timed relation with said means for advancing; and frame means for supporting said means for advancing, means for folding and means for operating.

2. A form handling device as recited in claim 1 wherein said swing chute further includes:

a swing chute frame;

means for mounting said swing chute frame on said frame means for supporting, whereon said swing chute frame may swing through said arc; and wherein said means for positively conveying comprises first and second conveying surfaces rotatably disposed on said swing chute frame in opposing relationship, adapted to receive a form between said conveying surfaces; and means for rotating said first and second conveying surfaces in opposite directions to positively advance a form therebetween.

3. A form handling device as recited in claim 2 wherein said means for mounting said swing chute defines a pivot axis along which said swing chute frame swings in said arc.

4. A form handling device as recited in claim 2 wherein said means for mounting comprises:

first and second sleeves adapted for attachment to opposite sides of said frame means; and first and second tubes rotatably disposed in said first and second sleeves and attached to opposing first and second ends of said swing chute frame, respectively.

5. A form handling device as recited in claim 4 wherein said means for mounting further comprises at least one bearing assembly disposed on each of said first and second tubes in said first and second sleeves.

6. A form handling device as recited in claim 5 wherein said first and second conveying surfaces each comprise:

at least two rotatable rollers extending across said swing chute frame defining the shape of said conveying surface; and one or more endless belts engaged on said at least two rotatable rollers.

7. A form handling device as recited in claim 6 wherein said one or more endless belts comprise a plurality of endless belts spaced across said rotatable rollers, said plurality of endless belts of said first conveying surface offset from ones of said belts of said second conveying surface.

8. A form handling device as recited in claim 7 wherein said plurality of endless belts of said first and second conveying surfaces intermesh to frictionally engage a form.

9. A form handling device as recited in claim 2 wherein said means for rotating rotates said first and second conveying surfaces at speeds substantially related to the rate at which said means for advancing advances said web and forms into said swing chute.

10. A form handling device as recited in claim 1 wherein the length of said arc in which said swing chute swings is substantially related to the size of pages in said web and forms.

11. A form handling device as recited in claim 1 wherein said means for operating said means for folding comprises a source of rotary power and a means for swinging said swing chute attached to said swing chute.

12. A form handling device as recited in claim 11 wherein said means for swinging comprises a reciprocating pivot arm.

13. A form handling device as recited in claim 1 further comprising means for severing said web.

14. A form handling device as recited in claim 13 wherein said means for severing comprises a rotary cutter disposed in said direction of web movement upstream from said means for folding.

15. A form handling device as recited in claim 13 wherein said means for receiving includes a means for stacking said web and forms in a stack; and wherein said means for severing is disposed downstream from said means for folding and is insertable in said stack of folded web and forms.

16. A form handling device as recited in claim 1 wherein said means for folding further comprises:

one or more knockdown fingers rotating in cooperation with said swing chute to urge said web and forms to fold.

17. A form handling device as recited in claim 1 wherein said means for folding further comprises:

one or more spirals rotating in cooperation with said swing chute to receive folded edges and ends of said web and forms and urge said web and forms to fold.

18. A form handling device as recited in claim 1 wherein said means for receiving comprises a delivery table.

19. A form handling device as recited in claim 18 wherein said means for receiving further comprises a box having two or more sides to control transverse motion of said web and forms during folding.

20. A form handling device as recited in claim 18 wherein said delivery table further comprises rotatable delivery belts for conveying said folded forms.

21. A form handling device as recited in claim 1 wherein said means for receiving comprises means for stacking said web and forms.

22. A form handling device as recited in claim 21 wherein said means for stacking comprises a delivery table adapted to convey a folded web or folded forms, and a stacker table.

23. A form handling device for advancing and folding a continuous web and forms of two or more pages, said form handling device comprising:

means for advancing a continuous web and forms in a direction of web movement;

means for folding said web and forms;

means for operating said means for folding in timed relation with said means for advancing; and frame means for supporting said means for advancing, means for folding and means for operating;

said means for folding including:

a swing chute adapted to swing through an arc defining a swing angle and further adapted to positively convey said web and forms, said swing chute comprising:

a swing chute frame;

means for mounting said swing chute frame on said frame means for supporting, said means for mounting comprising:

first and second sleeves adapted for attachment to opposite sides of said frame means; and first and second tubes rotatably disposed in said first and second sleeves and attached to opposing first and second ends of said swing chute frame, respectively; and at least one bearing assembly disposed on each of said first and second tubes in said first and second sleeves;

first and second conveying surfaces rotatably disposed on said swing chute frame in opposing relationship and adapted to receive a form between said conveying surfaces, each of said first and second conveying surfaces further comprising:

at least two rotatable rollers extending across said swing chute frame defining the shape of said conveying surface;

a plurality of endless belts engaged on said at least two rotatable rollers, ones of said plurality of endless belts on said first conveying surface offset from ones of said belts on said second conveying surface; and a plurality of outwardly tapered segments on at least one of said rotatable rollers, ones of said plurality of tapered segments engaging ones of said plurality of endless belts; and means for rotating said first and second conveying surfaces in opposite directions to positively advance a form therebetween; and means for receiving said web and forms from said swing chute whereon said web and forms are folded.

24. A form handling device for advancing and folding a continuous web and forms of two or more pages, said form handling device comprising:

means for advancing a continuous web and forms in a direction of web movement;

means for folding said web and forms comprising:

a swing chute adapted to swing through an arc defining a swing angle and further adapted to positively convey said web and forms, said swing chute further comprising:

a swing chute frame;

means for mounting said swing chute frame on said frame means for supporting, whereon said swing chute frame may swing through said arc; and means for rotating said first and second conveying surfaces in opposite directions to positively advance a form therebetween, said means for rotating comprising:

a rotatable drive shaft having a first end and a second end;

means for connecting said drive shaft at said first end to at least one of said first and second conveying surfaces; and means for driving said drive shaft attached thereto at said second end, said means for driving connected to said source of rotary power and adapted to transmit rotation therefrom to said drive shaft and adjust said rotation to compensate for relative motion between said drive shaft and said swing chute frame;

means for receiving said web and forms from said swing chute whereon said web and forms are folded; and means for operating said means for folding in timed relation with said means for advancing, said means for operating comprising a source of rotary power in timed relation with said means for advancing; and frame means for supporting said means for advancing, means for folding and means for operating.

25. A form handling device as recited in claim 24 wherein said means for operating further comprises means for swinging said swing chute attached to said swing chute.

26. A form handling device as recited in claim 24 wherein said means for connecting said drive shaft at said first end to said first and second conveying surfaces comprises:

a first pulley attached to said first end of said drive shaft;

a second pulley attached to said first conveying surface;

a conveyor drive belt engaged in said first and second pulleys, adapted to transmit rotary motion between said drive shaft and said first conveying surface; and first and second transmission gears disposed on said swing chute frame and attached, respectively, to said first and second conveying surfaces, adapted for rotating said second conveying surface at substantially the same speed as said first conveying surface.

27. A form handling device as recited in claim 24 wherein:

said means for mounting defines a pivot axis along which said swing chute frame swings in said arc, said drive shaft extending centrally through said means for mounting along said pivot axis; and said means for driving said drive shaft comprises a pulley and gear assembly having a fixed first gear box rigidly attached to said frame means and a movable second gear box;

said fixed first gear box comprising:

a first gear box frame;

a first gear disposed in said first gear box frame and connected to said means for mounting said swing chute frame, whereby said first gear and said swing chute frame oscillate in concert through substantially equal angles;

a first axle rotatably disposed in said first gear box frame substantially parallel to said means for mounting, said first axle extending from a first end mounted in said first gear box frame to a second end outside said first gear box frame;

a second gear rigidly connected to said first end of said first axle, said second gear having twice the diameter of said first gear and intermeshing therewith, thereby oscillating through substantially one-half the angle of said swing chute frame;

a third gear rigidly connected to said second end of said first axle and disposed outside said first gear box frame, whereby said third gear oscillates in concert with said second gear through substantially one-half the angle of said swing chute frame;

a fourth gear outside and adjacent to said first gear box frame, disposed on said means for mounting said swing chute frame and freely rotatable thereon, said fourth gear having substantially the same diameter as said third gear and intermeshing therewith, thereby oscillating through substantially one-half the angle of said swing chute frame; and said fourth gear further rigidly attached to said movable second gear box, whereby said second gear box may oscillate in concert therewith through substantially one-half the angle of said swing chute frame; and said movable second gear box disposed on said second end of said drive shaft, adapted to freely rotate thereon and oscillate through an arc, said second gear box comprising;

a second gear box frame disposed on said drive shaft and freely rotatable thereon, and attaching to said fourth gear;

an idler pulley disposed on said drive shaft and freely rotatable thereon within said second gear box frame, said idler pulley rotatably driven by said source of rotary power;

a first drive axle having first and second ends and parallel to said drive shaft, rotatably mounted in said second gear box frame, a drive pulley rigidly connected to said first drive axle at said first end, and a first drive belt engaged in said first idler pulley and said drive pulley, whereby rotary motion is imparted to said first drive axle;

a first drive gear rigidly connected to said first drive axle at said second end thereof;

a second drive gear rigidly connected to said drive shaft intermeshing with and rotatably driven by said first drive gear, whereby rotary motion from said source of rotary power is imparted to said drive shaft.

28. A form handling device as recited in claim 27 wherein said third and fourth gears have substantially one and one-half the diameter of said first gear.

29. A form handling device as recited in claim 27 wherein said first and second gears have substantially the same diameter and said third gear is one-half the diameter of said fourth gear.

30. A form handling device for advancing and folding a continuous web and forms of two or more pages, said form handling device comprising:

means for advancing a continuous web and forms in a direction of web movement;

means for folding said web and forms comprising:

a swing chute adapted to swing through an arc defining a swing angle and further adapted to positively convey said web and forms;

one or more fluted rollers adapted to contact unfolded edges of said web and forms to control said web and forms during folding and further urge said web and forms to fold;

means for receiving said web and forms from said swing chute whereon said web and forms are folded; and means for operating said means for folding in timed relation with said means for advancing; and frame means for supporting said means for advancing, means for folding and means for operating.

31. A swing chute for use in a form handling device having powered means for swinging a swing chute and having a source of rotary power, both operating in timed relation with the advance of a web and one or more forms in said form handling device, said swing chute comprising:

a swing chute frame adapted for attachment to a powered means for swinging;

means for mounting said swing chute frame in a form handling device adapted for swinging said swing chute frame in an arc defining a swing angle first and second conveying surfaces rotatably disposed in said swing chute frame in opposing relationship, adapted to receive a web and form therebetween; and means for rotating said first and second conveying surfaces in opposite directions to advance a web and form therebetween at a speed substantially related to the advance of said web and forms in said form handling device, said speed substantially unrelated to the position of said swing chute as it swings through said arc.

32. A swing chute as recited in claim 31 wherein said means for mounting defines a pivot axis along which said swing chute frame swings in an arc.

33. A swing chute as recited in claim 31 wherein said means for mounting comprises:

first and second sleeves adapted for rigid attachment to said form handling device; and first and second tubes rotatably disposed in said first and second sleeves and attached to opposing first and second ends of said swing chute frame, respectively.

34. A swing chute as recited in claim 33 wherein said means for mounting further comprises at least one bearing assembly disposed between each of said first and second tubes and said first and second sleeves, respectively.

35. A swing chute as recited in claim 31 wherein said first and second conveying surfaces each comprise:

at least two rotatable rollers extending across said swing chute frame defining the shape of said conveying surface; and one or more endless belts engaged on said at least two rotatable rollers.

36. A swing chute as recited in claim 34 wherein said one or more endless belts comprise a plurality of endless belts spaced across said rotatable rollers, and said plurality of endless belts of said first conveying surface are offset from ones of said belts of said second conveying surface.

37. A swing chute as recited in claim 36 wherein said plurality of endless belts on said first and second conveying surfaces intermesh to frictionally engage a form.

38. A swing chute as recited in claim 31 wherein said means for rotating rotates said first and second conveying surfaces at speeds substantially related to the rate at which said web is advanced into said swing chute by said form handling device.

39. A swing chute as recited in claim 31 wherein said means for rotating rotates said first and second conveying surfaces at speed substantially related to the rate at which at least one of said one or more forms advances in said form handling device.

40. A swing chute as recited in claim 31 wherein the rate at which said swing chute frame swings through said arc is substantially related to the rate at which at least one of said one or more forms advances into said form handling device.

41. A swing chute as recited in claim 31 wherein the rate at which said swing chute frame swings through said arc is substantially related to the rate at which said web advances in said form handling device.

42. A swing chute as recited in claim 32 wherein the length of said arc in which said swing chute swings is related to the size of pages of said web and forms handled in said form handling device.

43. A swing chute for use in a form handling device having powered means for swinging a swing chute and having a source of rotary power, both operating in timed relation with the advance of a web and one or more forms in said form handling device, said swing chute comprising:

a swing chute frame adapted for attachment to a powered means for swinging;

means for mounting said swing chute frame in a form handling device adapted for swinging said swing chute frame in an arc defining a swing angle;

first and second conveying surfaces rotatably disposed in said swing chute frame in opposing relationship, adapted to receive a web and form between said conveying surfaces, each of said first and second conveying surfaces comprising:

at least two rotatable rollers extending across said swing chute frame defining the shape of said conveying surface;

a plurality of endless belts engaged on and spaced across said rotatable rollers, ones of said plurality of endless belts of said first conveying surface offset from ones of said belts of said second conveying surface; and a plurality of tapered segments on at least one of said rotatable rollers, ones of said plurality of tapered segments engaging ones of said plurality of endless belts;

means for rotating said first and second conveying surfaces in opposite directions to advance a form therebetween.

44. A swing chute for use in a form handling device having powered means for swinging a swing chute and having a source of rotary power, both operating in timed relation with the advance of a web and one or more forms in said form handling device, said swing chute comprising:

a swing chute frame adapted for attachment to a powered means for swinging;

means for mounting said swing chute frame in a form handling device adapted for swinging said swing chute frame in an arc defining a swing angle;

first and second conveying surfaces rotatably disposed in said swing chute frame in opposing relationship, adapted to receive a web and form between said conveying surfaces; and means for rotating said first and second conveying surfaces in opposite directions to advance a web and form therebetween, said means for rotating comprising:

a rotatable drive shaft having a first end and a second end;

means for connecting said drive shaft at said first end to at least one of said first and second conveying surfaces; and means for driving said drive shaft attached thereto at said second end, said means for driving adapted to transmit rotation from a source of rotary power to said drive shaft and adjust said rotation to compensate for relative motion between said drive shaft and said swing chute frame;

whereby said first and second conveying surfaces are rotated at a speed substantially related to the advance of a web or one or more forms in said form handling device.

45. A swing chute as recited in claim 44 wherein said means for connecting said drive shaft to one of said first and second conveying surfaces comprises:

a first pulley attached to said first end of said drive shaft;

a second pulley attached to said first conveying surface;

a conveyor drive belt engaged in said first and second pulleys, adapted to transmit rotary motion between said drive shaft and said first conveying surface; and first and second transmission gears disposed on said swing chute frame and attached, respectively, to said first and second conveying surfaces, adapted for rotating said second conveying surface at substantially the same speed as said first conveyor surface.

46. A swing chute as recited in claim 44 wherein:

said means for mounting defines a pivot axis along which said swing chute swings in an arc, said drive shaft extending centrally through said means for mounting along said pivot axis; and said means for driving comprises a pulley and gear assembly having a fixed first gear box and a movable second gear box;

said fixed first gear box adapted for mounting on said form handling device and comprising:

a first gear box frame adapted for mounting on a form handling device;

a first gear disposed in said first gear box frame and connected to said means for mounting said swing chute frame, whereby said first gear and said swing chute frame oscillate in concert through substantially equal angles;

a first axle rotatably disposed in said first gear box frame substantially parallel to said means for mounting, said first axle extending from a first end mounted in said first gear box frame to a second end outside said first gear box frame;

a second gear rigidly connected to said first end of said first axle, said second gear having twice the diameter of said first gear and intermeshing therewith, thereby oscillating through substantially one-half the angle of said swing chute frame;

a third gear rigidly connected to said second end of said first axle and disposed outside said first gear box frame, whereby said third gear oscillates in concert with said second gear through substantially one-half the angle of said swing chute frame;

a fourth gear outside and adjacent to said first gear box frame, disposed on said means for mounting said swing chute frame and freely rotatable thereon, said fourth gear having substantially the same diameter as said third gear and intermeshing therewith, thereby oscillating through substantially one-half the angle of said swing chute frame; and said fourth gear further rigidly attached to said movable second gear box frame, whereby said second gear box may oscillate in concert therewith through substantially one-half the angle of said swing chute frame; and said movable second gear box disposed on said second end of said drive shaft, adapted to freely rotate thereon and oscillate through an arc, said second gear box comprising:

a second gear box frame disposed on said drive shaft and freely rotatable thereon;

an idler pulley disposed on said drive shaft and freely rotatable thereon within said second gear box frame, said idler pulley rotatably driven by said source of rotary power;

a first drive axle parallel to said drive shaft rotatably mounted in said second gear box frame, a drive pulley rigidly connected to said first drive axle, and a first drive belt engaged in said idler pulley and said drive pulley, whereby rotary motion is imparted to said first drive axle;

a first drive gear rigidly connected to said first drive axle;

a second drive gear rigidly connected to said drive shaft intermeshing with and rotatably driven by said first drive gear, whereby rotary motion from said source of rotary power is imparted to said drive shaft.

47. A swing chute as recited in claim 46 wherein said first and second gears have substantially the same diameter and said third gear is one-half the diameter of said fourth gear.

48. A swing chute for advancing forms in a form handling device at a speed substantially equal to that of one or more forms in said device, said swing chute comprising:

a swing chute frame adapted for attachment to a power means for swinging;

means for mounting said swing chute frame attached thereto, adapted to swing said swing chute frame in an arc defining a swing angle, wherein said means for mounting includes:

first and second sleeves adapted for attachment to a form handling device;

first and second tubes rotatably disposed in said first and second sleeves, rigidly attached to opposite ends of said swing chute frame, respectively, and oriented to define a swing axis;

first and second conveying surfaces rotatably disposed on said swing chute frame in opposing relationship, adapted to receive and advance a form therebetween, said first and second conveying surfaces each comprising, respectively:

at least two rotatable rollers extending across said swing chute frame defining the shape of said conveying surface; and one or more endless belts engage on said at least two rotatable rollers, whereby said endless belts frictionally engage a form; and means for rotating said first and second conveying surfaces in opposite directions to advance a form at a constant speed therebetween as said chute swings through an arc, said means for rotating comprising:

a rotatable drive shaft having first and second ends rotatably disposed along said swing axis through said first tube;

a means for connecting said drive shaft to at least one of said first and second conveying surfaces, said means for connecting attached at said first end of said drive shaft; and a means for driving said drive shaft attached at said second end thereof, said means for driving adapted to transmit rotation from a source of rotary power to said drive shaft, and further adapted to adjust said rotation to compensate for relative motion between said drive shaft and said swing chute frame, whereby said first and second conveying surfaces are rotated at a speed substantially related to the advance of one or more forms in said form handling device.

49. A method for separating and folding forms in a stack comprising the steps of:

advancing a web having perforated lines to a rotary cutter;

transversely severing said web along transverse cut lines made at one of said perforated lines to make forms of two or more pages;

advancing said forms into a means for folding, said means for folding including a swing chute adapted to swing through an arc defining a swing angle;

positively conveying said web and forms by said swing chute onto a means for receiving said web and forms at a speed substantially related to the advance of said web and forms, said speed substantially unrelated to the position of said swing chute as it swings through said arc; and folding said web and forms along said perforated lines on said means for receiving.

50. A method as recited in claim 49 further comprising the step of:

stacking said folded forms in a stack on said means for receiving.

51. A method as recited in claim 49 wherein said step of positively conveying further comprises temporarily imparting a corrugated shape to said forms as said means for folding conveys said forms onto said means for receiving.

52. A method as recited in claim 49 wherein said step of transversely severing occurs along cut lines offset from said perforated lines to make forms of two or more pages having tails; and said step of folding folds said web and forms along all perforated lines except that one which is adjacent the transverse cut line forming said tail.

53. A method for separating and folding forms in a stack comprising the steps of:

advancing a web having perforated lines to a rotary cutter;

transversely severing said web along transverse cut lines offset from said perforated lines to make forms of two or more pages having tails;

advancing said web and forms into a means for folding;

positively conveying said web and forms by said means for folding onto a means for receiving said web and forms; and folding said web and forms on said means for receiving along all said perforated lines except that one which is adjacent the transverse cut line forming said tail.

54. A method as recited in claim 53 further comprising the step of:

stacking said folded forms in a stack on said means for receiving so that said tails of said folded forms extend beyond an edge of said stack.

55. A method as recited in claim 53 further comprising the step of:

separating said forms from said stack by reference to said tails.

56. A form handling device for advancing and folding a continuous web and forms of two or more pages, said form handling device comprising:

means for feeding a continuous web with transverse cuts into forms having two or more pages, said means for severing spaced in said direction of web movement from said means for feeding;

means for advancing said web and forms in said direction of web movement from said means for severing;

means for folding said web and forms, said means for folding spaced from said means for advancing, said means for folding comprising:

a swing chute adapted to swing through an arc defining a swing angle and further adapted to receive and positively convey said web and forms therethrough, said swing chute including:

first and second conveying surfaces rotatably disposed to engage said web and form therebetween; and means for rotating said first and second conveying surfaces in opposite directions to positively advance said web and form therebetween at a speed substantially related to the advance of said web and forms, said speed substantially unrelated to the position of said swing chute as it swings through said arc;

means for receiving said web and forms from said swing chute whereon said web and forms are folded; and means for operating said means for folding in timed relation with said means for advancing; and frame means for supporting said means for feeding, means for severing, means for advancing, means for folding and means for operating.

57. A swing chute for use in a form handling device having powered means for swinging a swing chute and having a source of rotary power, both operating in timed relation with the advance of a web and one or more forms in said form handling device, said swing chute comprising:

a swing chute frame adapted for attachment to a powered means for swinging;

means for mounting said swing chute frame in a form handling device adapted for swinging said swing chute frame in an arc defining a swing angle;

means for positively conveying said web and forms through said swing chute, said means for positively conveying operable to positively convey said web and forms at a speed substantially related to the advance of said web and forms in said form handling device, said speed substantially unrelated to the position of said swing chute as it swings through said arc.

58. A method for folding a continuous web and forms from a form handling device, where the form handling device has powered means for swinging a swing chute and has a source of rotary power, both operating in timed relation with the advance of a web and one or more forms in the form handling device, said method comprising the steps of:

advancing a web and forms having perforated lines into a means for folding, said means for folding including a swing chute adapted to swing through an arc defining a swing angle;

positively conveying said web and forms through said swing chute onto a means for receiving said web and forms, said step of positively conveying performed at a speed substantially related to the advance of said forms, said speed substantially unrelated to the position of said swing chute as it swings through said arc; and folding said web and forms along said perforated lines on said means for receiving.

* * * * *

UNITED STATES PATENT AND TRADEMARK OFFICE

CERTIFICATE OF CORRECTION

PATENT NO. : 5,087,023

DATED : February 11, 1992

INVENTOR(S) : Gilbert et al

It is certified that error appears in the above-identified patent and that said Letters Patent is hereby corrected as shown below:

Col. 20, lines 8-11, "means for feeding a continuous web with transverse cuts into forms having two or more pages, said means for severing spaced in said direction of web movement from said means for feeding;" should read --means for feeding a continuous web for folding in a direction of web movement;

means for severing said continuous web with transverse cuts into forms having two or more pages, said means for severing spaced in said direction of web movement from said means for feeding;--.

Signed and Sealed this

Fourth Day of May, 1993

*Attest:*

Michael K. Kirk

MICHAEL K. KIRK

*Attesting Officer*

*Acting Commissioner of Patents and Trademarks*